US009879568B2

(12) United States Patent
Van Beveren

(10) Patent No.: US 9,879,568 B2
(45) Date of Patent: Jan. 30, 2018

(54) METHOD FOR ENERGY SAVING

(71) Applicant: P.T.I.

(72) Inventor: Petrus Carolus Van Beveren, Hoogerheide (NL)

(73) Assignee: P.T.I., Hoogerheide (NL)

( * ) Notice: Subject to any disclaimer, the term of this patent is extended or adjusted under 35 U.S.C. 154(b) by 114 days.

(21) Appl. No.: 14/903,309

(22) PCT Filed: Jul. 1, 2014

(86) PCT No.: PCT/IB2014/001244
§ 371 (c)(1),
(2) Date: Jan. 7, 2016

(87) PCT Pub. No.: WO2015/004515
PCT Pub. Date: Jan. 15, 2015

(65) Prior Publication Data

US 2016/0146058 A1 May 26, 2016

(30) Foreign Application Priority Data

Jul. 9, 2013 (BE) ..... 2013/0478

(51) Int. Cl.
*F01K 17/00* (2006.01)
*F25B 30/06* (2006.01)
(Continued)

(52) U.S. Cl.
CPC ..... *F01K 17/005* (2013.01); *F01K 7/16* (2013.01); *F01K 11/02* (2013.01); *F01K 17/02* (2013.01);
(Continued)

(58) Field of Classification Search
CPC ..... F01K 17/005; F01K 21/00; F01K 25/04; F01K 11/02; F01K 7/16; F01K 23/04; F01K 25/106; F01K 25/065; F01K 17/02
(Continued)

(56) References Cited

U.S. PATENT DOCUMENTS 4,228,657 A * 10/1980 Leo ..... F01K 7/00 418/83
4,573,321 A 3/1986 Knaebel
(Continued)

FOREIGN PATENT DOCUMENTS

CN 202562132 U 11/2012
EP 1553264 A2 7/2005
(Continued)

*Primary Examiner* — Hoang Nguyen
(74) *Attorney, Agent, or Firm* — James Creighton Wray; Meera P. Narasimhan

(57) ABSTRACT

Method for coupling a first heat-requiring industrial process to a second cold-requiring industrial process, whereby a first circuit for energy recovery (1) from the first industrial process transfers heat to a second circuit for cold production (2) for the second industrial process, wherein the first circuit for energy recovery (1) the energy carrier is a binary mixture of water and ammonia that has two-phases and is compressed by a compressor (7) specifically suitable for compressing a two-phase fluid such as a compressor with a Lysholm rotor or equipped with vanes, whereby all or part of the liquid phase evaporates as a result of compression such that overheating does not occur and such that less working energy must be supplied.

12 Claims, 4 Drawing Sheets

(51) Int. Cl.

| | |
|---|---|
| ***F01K 17/02*** | (2006.01) |
| ***F01K 23/04*** | (2006.01) |
| ***F01K 25/06*** | (2006.01) |
| ***F01K 25/10*** | (2006.01) |
| ***F01K 25/04*** | (2006.01) |
| ***F01K 7/16*** | (2006.01) |
| ***F01K 11/02*** | (2006.01) |
| ***F01K 21/00*** | (2006.01) |
| ***F25B 30/02*** | (2006.01) |

(52) U.S. Cl.
CPC ..... *F01K 21/00* (2013.01); *F01K 23/04* (2013.01); *F01K 25/04* (2013.01); *F01K 25/065* (2013.01); *F01K 25/106* (2013.01); *F25B 30/02* (2013.01); *F25B 30/06* (2013.01)

(58) Field of Classification Search
USPC ..... 60/650, 655, 659, 682–684
See application file for complete search history.

(56) References Cited

U.S. PATENT DOCUMENTS

| | | | | |
|---|---|---|---|---|
| 5,440,882 | A * | 8/1995 | Kalina | F01K 23/04 60/641.2 |
| 5,557,936 | A * | 9/1996 | Drnevich | F01K 25/065 252/67 |
| 6,604,364 | B1 * | 8/2003 | Arman | F01K 25/065 60/520 |
| 8,572,972 | B2 * | 11/2013 | Frey | F01K 3/02 60/641.14 |
| 2010/0089062 | A1 * | 4/2010 | Cao | F01C 1/22 60/682 |
| 2012/0090291 | A1 * | 4/2012 | Feinstein | F02C 3/113 60/39.281 |

FOREIGN PATENT DOCUMENTS

| | | | |
|---|---|---|---|
| EP | 2514931 | A1 | 10/2012 |
| GB | 2034012 | A | 5/1980 |
| WO | 2009045196 | A1 | 4/2009 |
| WO | 2011081666 | A1 | 7/2011 |
| WO | 2013035822 | A1 | 3/2013 |

* cited by examiner

METHOD FOR ENERGY SAVING

This application claims the benefit of Belgian Application No. 2013/0478 filed Jul. 9, 2013, and PCT/IB2014/001244 filed Jul. 1, 2014, International Publication No. WO 2015/004515, and the amended sheets, which are hereby incorporated by reference in their entirety as if fully set forth herein.

The present invention relates to a device for energy saving and method whereby such a device is applied in industrial processes.

More specifically, the invention is intended for the recovery of energy by coupling a heat-requiring industrial process to a cold-requiring industrial process.

It is known that many industrial processes require heat. An example is the process whereby French fried potatoes are fried in vegetable oil at 180° C.

It is also known that many industrial processes require cold. An example is the freezing of pre-fried French fried potatoes at a temperature of −33° C.

Traditionally a lot of energy is lost in a heat-requiring industrial process due to cooling and the emission of heat to the atmosphere. In the process in which potatoes are fried as French fried potatoes or potato crisps for example, when frying, water present in the potatoes evaporates, and the steam and oil vapour formed is cooled in the air, so that the heat energy therein is emitted to the atmosphere.

In order to entirely or partially utilise this heat energy, it is known to exchange the heat of these vapours with another medium such that the water and oil in the vapour condenses. It is also known that when the other medium is water, hot water can hereby be produced.

The compressed binary medium is then guided through a heat exchanger that acts as a heating installation for the cooking oil still to be heated up, i.e. cooled cooking oil from the fryer and new cooking oil that makes up for the loss of cooking oil, whereby a proportion of the heat from the compressed binary medium is emitted to the cooled or new cooking oil such that this binary medium entirely or partially condenses.

Then the entirely or partially condensed binary medium is expanded in an expander whereby electrical energy is generated. The flow of fluid that leaves the expander is a flow that comprises two phases (liquid and vapour) that is traditionally fed back to the condenser where the vapour is condensed into liquid and whereby the energy-recovery circuit is closed.

Also in an industrial process whereby refrigeration to deepfreeze temperatures (approx. −30° C.) is required, part of the energy that must be supplied to obtain the refrigeration is not recovered by means of an expander that generates electricity, but by means of a reducing valve that reduces the pressure in order to develop cold according to the Joule-Thomson effect. Using a condenser the heat energy developed by the compressor is emitted to the atmosphere, in heat exchangers with which the heated and compressed coolant gas is cooled.

The refrigeration is obtained by compressing a suitable coolant gas, generally ammonia, after which the compressed and condensed coolant gas is expanded in a reducing valve whereby the temperature of the coolant gas falls sharply and is further guided to a phase separator that separates the gas phase from the cold liquid phase (approx. −30° C.) which can be used for all kinds of refrigerating installations such as a freezer line, a frozen storage zone and other cold stores.

The heated coolant gas that results after refrigeration can now be compressed again, partly with the electricity generated, in order to be expanded as a compressed coolant gas in an expander whereby the coolant gas circuit is closed.

Extra energy saving is possible by transferring heat from a first industrial process to which heat has been supplied to another industrial process whereby cold must be produced. This is possible by converting the low value residual heat of the first industrial process into high value cold for the second industrial process that requires cold.

In the aforementioned example the process for frying potatoes to prepare French fried potatoes is coupled to the process for freezing these French fried potatoes and putting them on the market as a frozen product, resulting in an extra energy saving.

In order to measure the efficiency of an industrial energy-saving process, an energy coefficient of performance (COP) is frequently used that reflects the ratio of the recovered energy with respect to the energy that must be supplied for the recovery thereof. Only when this COP is greater than two and a half (2.5) is the recovery process economically worthwhile in view of the KWe and KWth price ratio.

A number of systems for heat recovery from a heat-requiring process are already known.

WO2009/045196 and EP 2514931 describe heat recovery from a heat source by means of cascaded Rankine cycles with organic energy carriers that are not compressed by compressors.

WO2013/035822 also describes heat recovery by means of cascaded Rankine cycles, each with a pure substance as an energy carrier and without a compressor.

CN202562132 describes the coupling of a heat-requiring process (swimming pool) to a cold-requiring process (ice rink) and uses a compressor for a gaseous energy carrier.

U.S. Pat. No. 4,573,321 recovers heat from a heat source by means of a coolant composed of a component with high volatility and components with low volatility. The method does not use a compressor but countercurrent heat exchangers.

WO2011/081666 recovers heat with a Rankine cycle that uses ammonia as an energy carrier and uses a compressor for compressing CO2 gas whereby heat is exchanged between CO2 and ammonia in heat exchangers.

The purpose of the present invention is to enable extra energy saving when transferring heat from a heat-requiring first industrial process to a cold-requiring second industrial process, whereby in a first circuit for energy recovery linked to the first industrial process the energy carrier is two-phase and is compressed by a compressor that increases the pressure and temperature of the energy carrier for the first circuit for energy recovery, and whereby the compressor is specifically suitable for compressing a two-phase fluid such that the total energy coefficient of performance or COP of the coupled processes is increased with respect to the total COP of non-coupled processes.

An advantage of the use of such a compressor suitable for a two-phase fluid is that it consumes less energy to compress a two-phase fluid to a certain temperature and pressure than to compress an exclusively gaseous fluid to this temperature and pressure. In a two-phase fluid, all or part of the liquid phase evaporates as a result of compression such that overheating does not occur and such that less working energy must be supplied.

Preferably the circuit for energy recovery from the first industrial process transfers heat to a circuit for cold production of the second process, whereby the heat of the energy carrier in the first circuit, which remains after expanding the energy carrier in an expander for electricity generation, is additionally utilised to heat the energy carrier of the second circuit by means of a heat exchanger between the first circuit for energy recovery and the second circuit for cold production that additionally heats the energy carrier of the second process before it is expanded in the expander of the second circuit for electricity and cold production.

An advantage of this coupling of the two circuits is that the total energy saving for the coupled circuits is greater than the sum of the energy recovery of each circuit when they are not coupled.

Preferably the energy carriers of the first and second circuit for energy saving differ from one another. For example the energy carrier of the second circuit for energy saving can have a lower boiling point than the energy carrier of the first circuit for energy recovery, such that it is suitable for use in refrigerating installations.

Part of the heat that remains after expanding the energy carrier in the first expander for electricity generation is recovered by this coupling as electrical energy in the second expander.

Preferably a proportion of the heat that is generated by a compressor in the energy carrier of the first circuit for energy recovery is used to heat a process fluid in the form of a liquid or gas in the first industrial process, and this by means of a heat exchanger between the first circuit for energy recovery and a pipe for the supply of the process fluid to the process vessel of the first industrial process, where it is brought to the desired temperature for a production stage in the first industrial process.

An advantage of this utilisation of recovered heat for use in a production stage in the first industrial process is that less energy needs to be supplied from the outside, which leads to an energy saving in the first industrial process.

The energy carrier of the first circuit for energy saving is a two phase fluid i.e. consists of a mixture of a liquid phase and a vapour or gas phase.

An advantage of such an energy carrier is that it can be brought to the liquid or gas state according to desire by controlling the pressure and temperature.

Preferably the compressor of the first circuit for energy recovery is a compressor that is specifically suitable for compressing a two-phase fluid, such as a compressor with a Lysholm rotor or equipped with vanes or a variant developed to this end.

An advantage of the use of such a compressor is that it is suitable for compressing a fluid that partly consists of a liquid phase and partly of a vapour or gas phase.

The energy carrier of the second circuit for cold production has a binary composition, and consists of water and ammonia, whereby an entire or partial phase transition between the gas phase and liquid phase occurs that is then brought to a higher pressure by means of a compressor.

At atmospheric pressure ammonia has a boiling point of −33° C., such that a low temperature can be obtained due to the expansion of the energy carrier.

An advantage of ammonia as an energy carrier is that its low boiling point enables the energy carrier to be utilised in liquid form for industrial refrigeration processes such as the freezing of foodstuffs or other substances.

Preferably the second circuit for cold production is equipped with an electric pump with which the energy carrier of the second circuit for cold production is brought to a higher pressure before being expanded in the expander of the second circuit for cold production.

An advantage of this electric pump is that it brings the energy carrier to a higher pressure, such that more energy can be released by expansion in the expander and that it can be partially driven by recovered electricity originating from one or both expanders of the coupled industrial processes.

Preferably the second circuit for cold production comprises a separator, between the expander for expanding and a compressor for compressing the energy carrier, for separating the liquid phase from the gas phase in the energy carrier, followed by one or more refrigerating installations for one or more production stages in the second industrial process that utilises the liquid phase for cooling.

An advantage of this separator is that the liquid phase of the energy carrier can be guided to the industrial refrigerating installations that are thereby cooled, while the gas phase can be guided to a compressor to increase the pressure in the gas phase.

Preferably the energy carrier of the second circuit for cold production, after compression in a compressor to a pressure whereby it becomes liquid again due to ambient cooling, is further guided to a heat exchanger in which as an option surplus heat can be transferred from the energy carrier to another process liquid that is used elsewhere in the coupled production processes, in this case demineralised water that is converted to steam.

An advantage of this heat exchanger is that surplus heat can be utilised directly in the industrial process such that less external energy needs to be supplied to reach the required temperature.

Preferably the heat exchanger for the surplus heat of the energy carrier is connected by means of a tap to a separator in which saturated steam and saturated demineralised water are separated from one another at a pressure of 400 kPa.

An advantage of this separator is that steam can be produced for utilisation in the industrial process.

Preferably the condensed part of the separator is fed back to the supply flow of this heat exchanger, as well as the condensate from the consumed steam.

The water originating from another separator, with which the water vapour originating from the first production process, in this case the water that evaporates from the potatoes due to the frying process, is recovered, and after filtration is available for the first industrial process, which reduces the need for potable water in the first industrial production process.

The energy carrier of the second circuit for cooling is now further guided in gas form to a condenser in which the gas is condensed into a liquid and further guided to a pump that further drives the energy carrier to a heat exchanger between the first circuit for energy recovery and the second circuit for cold production, after which the energy carrier of the second circuit for cold production is reused in a subsequent cycle.

The advantage of this heat exchanger is that it enables heat transfer between the first circuit for energy recovery and the second circuit for cold production, such that both industrial processes are connected together.

With the intention of better showing the characteristics of the invention, a preferred embodiment of a device for energy saving according to the invention is described hereinafter by way of an example, without any limiting nature, with reference to the accompanying drawings, wherein:

BRIEF DESCRIPTION OF THE DRAWINGS

FIG. 1 shows the flow diagram of a circuit for heat recovery 1 of a first industrial production process that is coupled to a second circuit for cold production 2 of a second industrial production process. The first industrial production process 3 supplies hot gases or vapours that flow through pipe 4 to a heat exchanger 5 that forms part of the first circuit for heat recovery 1 and in which the energy carrier, i.e. a binary mixture of water and ammonia, of this first circuit is heated and guided via pipe 6 to a compressor 7, suitable for compressing a two-phase mixture from where the compressed energy carrier is guided via pipe 8 to a second heat exchanger 9 for steam production, and is further guided via pipe 10 to an expander 11 in which the energy carrier is expanded and further guided via pipe 12 to a third heat exchanger 13 for heat transfer to a circuit for cold production in the second industrial process 2, and is guided further via pipe 14 to a pump 15 that drives the energy carrier of the first circuit to the first heat exchanger 5 via pipe 16, in order to be heated again and to go through the first circuit 1 again for energy recovery.

DETAILED DESCRIPTION

Figure 1:
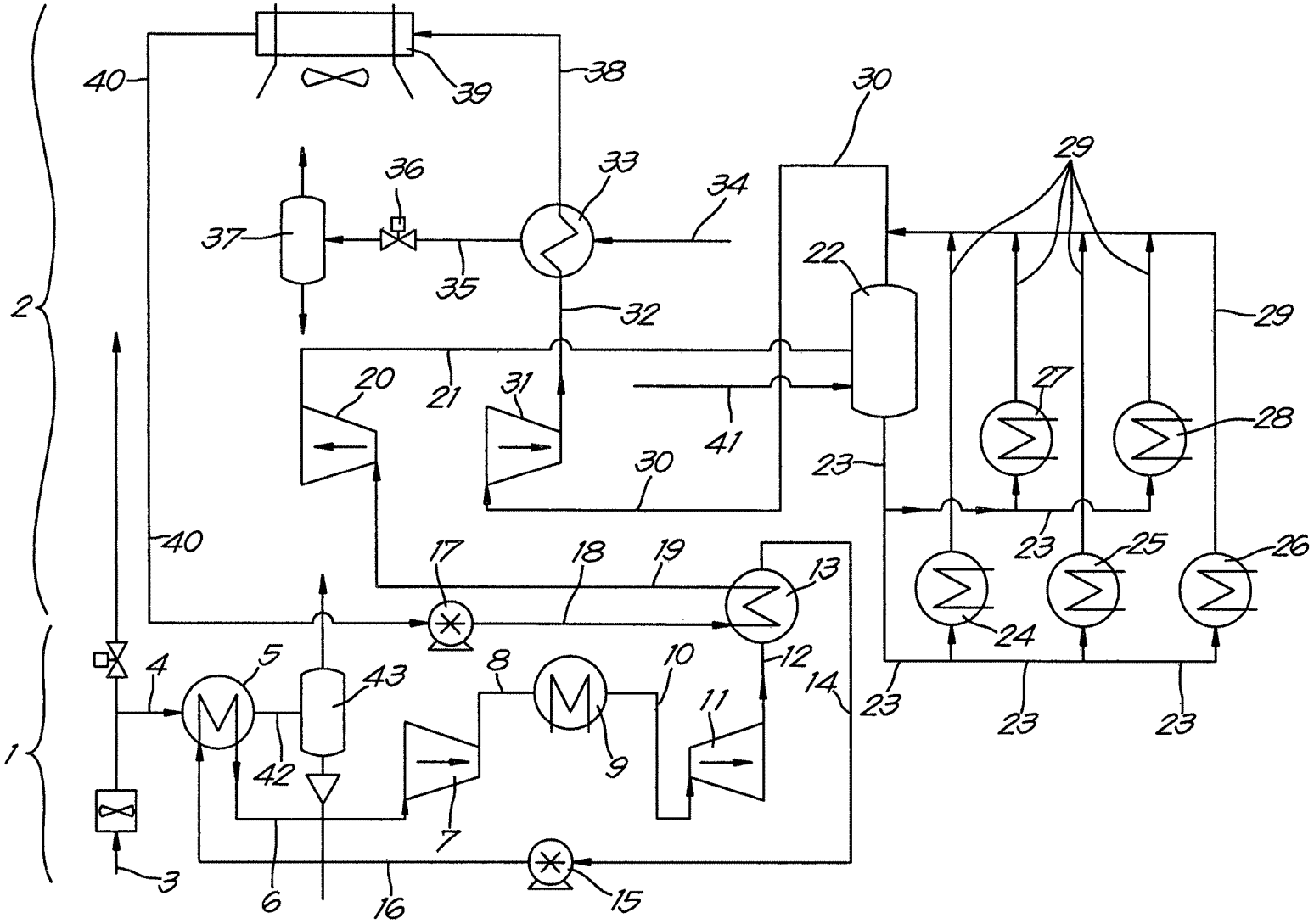
FIG. 1 schematically shows a flow diagram of two industrial processes connected together according to the invention.
Figure 2:
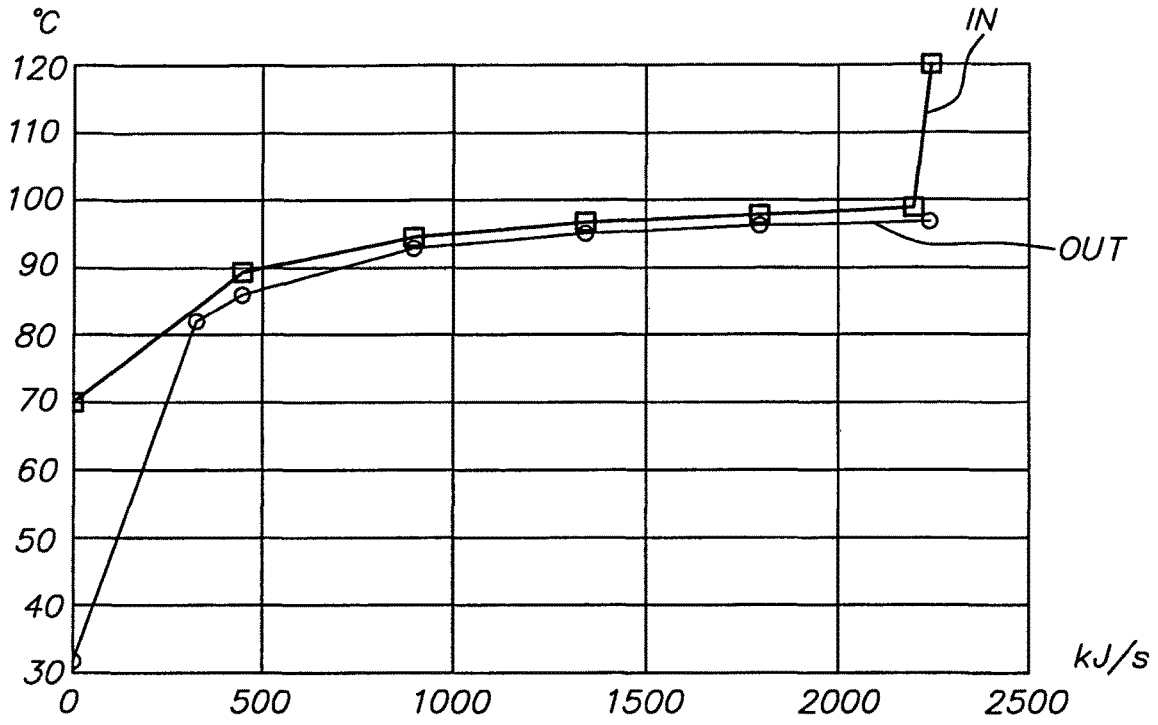
FIGS. 2 to 5 show the heat flow as a function of the temperature through the heat exchangers 5, 9, 13 and 33 of FIG. 1.
Figure 3:
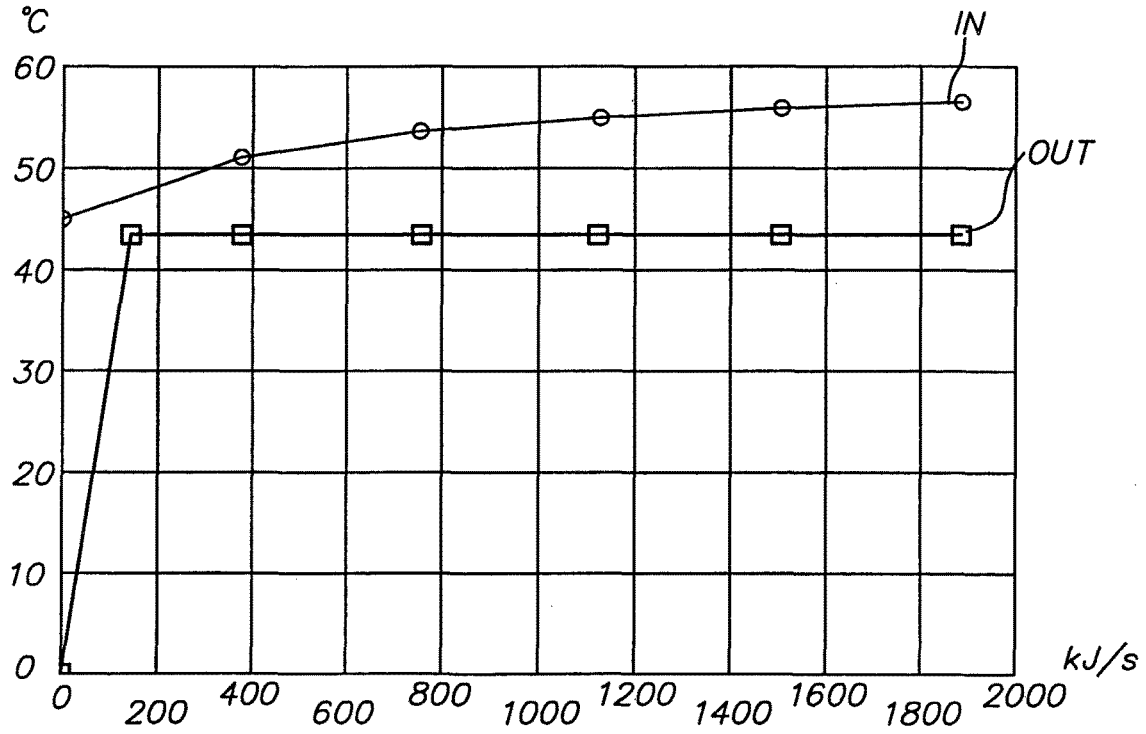
Figure 4:
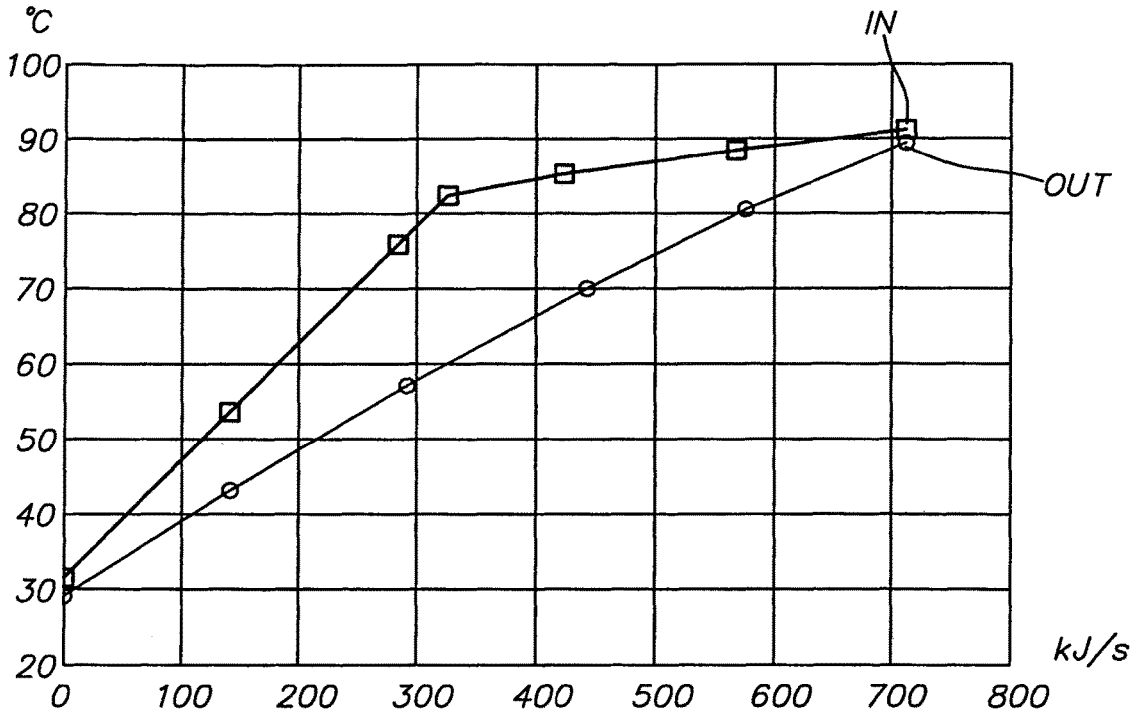

The pump 17 in the second circuit for cold production 2 drives the energy carrier of this second circuit for cold production, i.e. ammonia, via pipe 18 to the heat exchanger 13 in which the energy carrier absorbs heat from the first circuit for energy recovery 1, and is guided via pipe 19 to an expander in which the energy carrier is expanded, and is further guided via pipe 21 to a separator 22 for separating the gas phase and the liquid phase of the energy carrier from where the liquid phase of the energy carrier is guided via pipe 23 to industrial refrigerating devices, in this case a freezer tunnel 24, a frozen storage area 25 and a chilled area 26 for the collection of orders, and to other refrigerating installations 27,28 that all form part of the second industrial production process where cold is required.

The evaporated energy carrier from the refrigerating devices is combined with the gas phase from the separator 22 via the pipes 29 and further guided via pipe 30 to a compressor 31 from where the compressed gas is guided via pipe 32 to the heat exchanger 33 where surplus heat can be emitted to a flow of demineralised water 34, that can flow to a steam generator 37 via pipe 35 when the tap 36 is open. The energy carrier of the second circuit for cold production is guided from the heat exchanger 33 via pipe 38 to a heat exchanger 39, in which the energy carrier is condensed by an air flow, after which the energy carrier is further guided via pipe 40 to the pump 17 from where the energy carrier is further guided by pipe 18 and reused in a subsequent cycle of the second circuit 2 for cold production. Additional supplements of energy carrier in the second circuit for cold production can be added via pipe 41 to the liquid phase in the separator 22. Via pipe 42 hot gases, that are supplied from the first production process 3, are used for heating water in the generator 43 for hot water.

Figure 5:
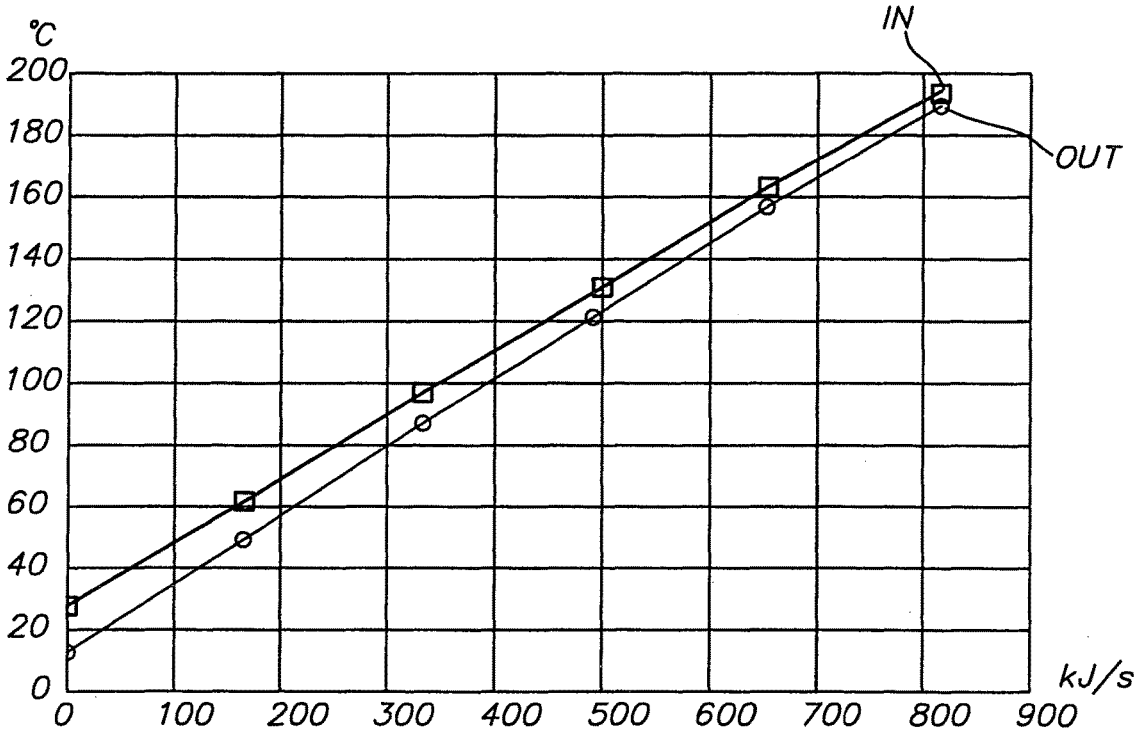

FIGS. 2 to 5 graphically show the relationship between the temperature in ° C. of the energy carrier and the heat flow in KJ/s through the subsequent heat exchangers: 5 (FIG. 2), 9 (FIG. 3), 13 (FIGS. 4) and 33 (FIG. 5). The temperature of the flow that is heated (OUT), and of the flow that is cooled (IN) in the heat exchanger, is indicated in each case.

Figure 6:
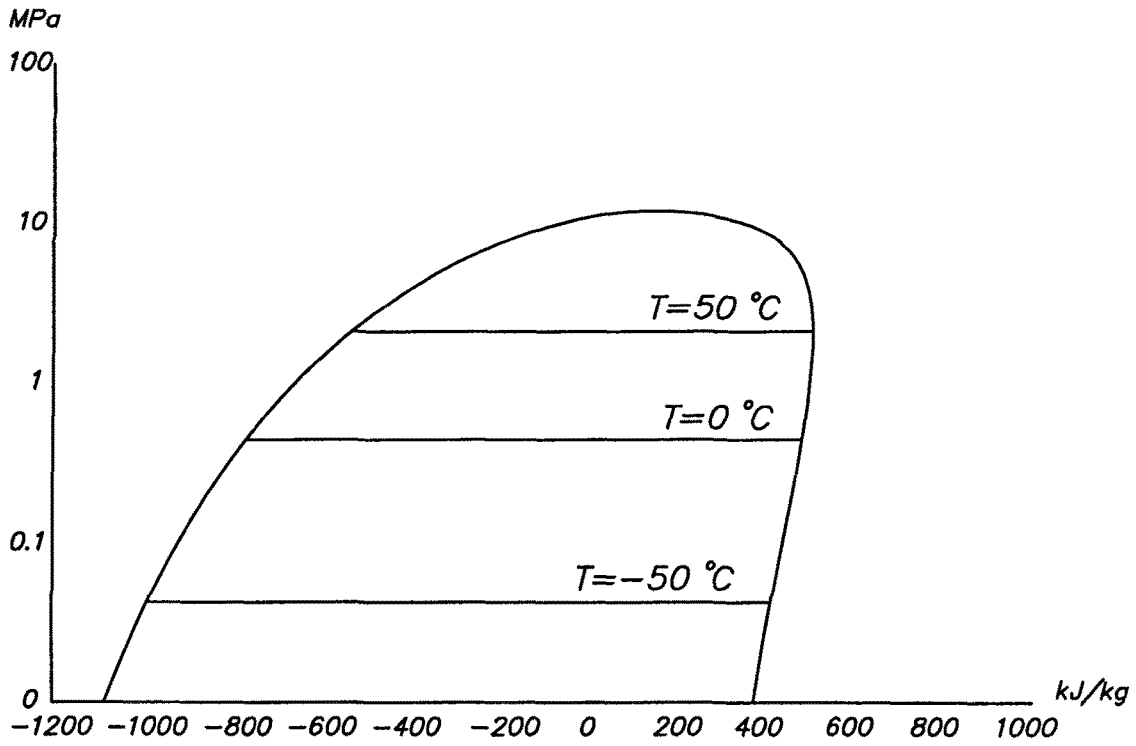
FIG. 6 shows the pressure-enthalpy diagram of ammonia.

FIG. 6 shows a Mollier diagram of ammonia, the preferred energy carrier of the second circuit for cold production, whereby the enthalpy is presented along the abscissa in kJ/kg, and the pressure along the ordinate in MPa.

The curve presents all pressure and enthalpy points where the liquid phase (below the curve) is in equilibrium with the gas phase (above the curve).

The operation of the device 1 is very simple and as follows.

A first production process that requires heat can be an industrial frying installation for French fried potatoes for example, in which they are pre-fried, or it can be an installation for frying potato crisps.

The first production process 3 that requires heat is provided with a first circuit 1 for energy recovery in which the energy present in the hot vapours originating from the first production process 3 is partly recovered by transferring the heat of the hot gases in a heat exchanger 5 to an energy carrier, i.e. a mixture of water and ammonia, present in this first circuit 1 and then expanding the energy carrier in an expander 11 with which electrical energy is generated that can be used in the process again.

Another fraction of the energy present in the hot vapours is utilised to generate hot water by guiding this fraction through pipe 42 to a hot water generator 43.

Another fraction of the energy present in the hot gases is transferred via heat exchanger 13 from the energy carrier in the first circuit 1 for energy recovery to the energy carrier, i.e. ammonia, in a second circuit 2 for cold production, whereby the transferred heat is utilised to heat the energy carrier of the second circuit 2 for cold production before it is expanded in expander 20 with which electrical energy is generated that can be used in the process again.

The cooled energy carrier of the second circuit 2 is guided to a separator 22 that separates the liquid phase of the energy carrier from the gas phase, after which the liquid phase (−33° C.) is utilised in the second industrial process that requires cold, and from which the refrigerating installations are supplied with the liquid phase of the second energy carrier via the pipes 23 so that applications, such as a freezer tunnel 24, a frozen storage area 25, a collection zone 26 for frozen goods and other refrigerating installations 27,28 can be cooled. The second industrial process that requires cold can be the frozen and chilled storage of foodstuffs for example.

For maximum energy recovery for the two coupled industrial processes it is advantageous to have a different energy carrier in the first circuit for energy recovery and in the second circuit for cold production. In the given example the energy carrier of the first circuit is water with a fraction of ammonia, while the energy carrier in the second circuit is ammonia.

After expansion in the expander 11 the first energy carrier is a two-phase flow that has already been cooled, but from which more heat energy can be emitted to the second energy carrier, pure ammonia, that has a much lower boiling point (−33° C.), and this absorbs heat in the heat exchanger 13. This additional heat is utilised in the expander 20 of the second circuit for cold production, where the energy carrier of the second circuit is expanded.

The ammonia of the second circuit for cold production heated in the heat exchanger 13 is expanded in the expander 20 whereby the energy carrier becomes two phase (liquid and gas), whereby these phases are separated from one another in the separator 22. The liquid phase, liquid ammonia, has a temperature of −33° C. and can be used for the connected industrial refrigerating installations.

The pressure-enthalpy diagram of FIG. 6 shows how much energy (work) can be recovered by lowering the pressure of ammonia in the liquid phase to a two-phase system, whereby this energy is extracted from the expander as electricity.

In the following tables the energy coefficient of performance or COP is calculated for two examples of a heat-requiring process to a cold-requiring process.

Table 1 gives the energy account for an installation for French fried potato production, coupled to a freezing installation. The energy recovered column gives the sum of all saved energy, while the energy supplied column gives the sum of the energy that had to be supplied to enable recovery. The ratio of the recovered energy to supplied energy or COP is 3.95 in this case and is higher than the COP for the total process in which the circuits for energy recovery and cold production are not coupled.

TABLE I energy account for French fried potato production coupled to freezing installation.
Energy account potato crisp production and refrigerating installation

| Energy saved | | Energy supplied | |
|---|---|---|---|
| gain | kWh | Loss | kWh |
| Hot water | 323 | Electricity | 1206 |
| Water/steam | 815 | | |
| Steam | 1888 | | |
| Refrigeration | 1744 | | |
| Water prod. | | | |

Table II shows the energy account for an installation for potato crisp production, without coupling to a second industrial process. The energy recovered column gives the sum of all saved energy, while the energy supplied column gives the sum of the energy that had to be supplied to enable recovery. The ratio of the recovered energy to supplied energy or COP is 4.59 in this case.

TABLE II energy account for potato crisp production.
Energy account potato crisp production

| Energy saved | | Energy supplied | |
|---|---|---|---|
| gain | kWh | Loss | kWh |
| Hot water | 595 | Electricity | 896 |
| Oil heating | 3513 | | |
| Water Prod. | | | |

It goes without saying that the invention can be applied to couple any industrial processes whereby one process requires heating and the other process requires cooling.

The invention can also be applied at different temperature ranges and with different energy carriers than those stated in the examples, as long as they can be two-phase for the first circuit for heat recovery.

The present invention is by no means limited to the embodiments described as an example and shown in the drawings, but a device for energy saving according to the invention can be realised in all kinds of forms and dimensions, without departing from the scope of the invention, as described in the following claims.

The invention claimed is:

1. Method for coupling a first heat-requiring industrial process to a second cold-requiring industrial process, whereby a first circuit for energy recovery (1) from the first industrial process transfers heat to a second circuit for cold production (2) for the second cold-requiring industrial process, wherein in the first circuit for energy recovery (1) the energy carrier is a binary mixture of water and ammonia that has two phases and is compressed by a compressor (7) specifically suitable for compressing a two-phase fluid, whereby all or part of the liquid phase evaporates as a result of compression such that overheating does not occur, whereby the circuit for energy recovery (1) of the first industrial process is coupled to the circuit for cold production (2) of the second industrial process, wherein the heat of the energy carrier in the first circuit for energy recovery, that remains after the expansion of the energy carrier in an expander (11) for electricity generation, is additionally utilised to heat the energy carrier of the second industrial process by means of a heat exchanger (13) between the first circuit (1) for energy recovery and the second circuit (2) for cold production that additionally heats the energy carrier of the second industrial process before it is expanded in the expander (20) for electricity and cold production of the second circuit (2) for cold production, wherein the second circuit (2) for cold production comprises a separator (22), between the expander (20) for expanding and a compressor (31) for compressing the energy carrier, for separating the liquid phase from the gas phase in the energy carrier, followed by one or more refrigerating installations (24,25, 26,27,28) for one or more production stages in the second industrial process.

2. Method according to claim 1, wherein the energy carriers of the first (1) circuit for energy recovery and the second circuit (2) for cold production differ from one another.

3. Method according to claim 1, wherein the energy carrier of the second circuit (2) for cold production has a lower boiling point than the energy carrier of the first circuit (1) for energy recovery.

4. Method according to claim 1, wherein a proportion of the heat that is generated in the energy carrier of the first circuit (1) for energy recovery by a compressor (7), is utilised to heat a process fluid in the form of a liquid or a gas in the first industrial process (3) and this by means of a heat exchanger (9) between the first circuit (1) for energy recovery and a pipe for the supply of the process fluid to the process vessel of the first industrial process (3), where it is brought to the desired temperature for a production stage in the first industrial process.

5. Method according to claim 1, wherein the energy carrier of the second circuit (2) for cold production is ammonia.

6. Method according to claim 1, wherein t the second circuit (2) for cold production is equipped with an electric pump (17), by which the energy carrier of the second circuit (2) for cold production is brought to a higher pressure before being expanded in an expander (20) of the second circuit (2) for cold production.

7. Method according to claim 1, wherein the energy carrier of the second circuit (2) for cold production, after compression in a compressor (31) to a pressure whereby it becomes liquid again, is further guided to a heat exchanger (33), wherein surplus heat from the energy carrier can be optionally transferred to another process liquid that is used elsewhere in the coupled production processes.

8. Method according to claim 1, wherein the heat exchanger (33) for the surplus heat of the energy carrier is connected by means of a tap (36) to a separator (37) in which saturated steam and saturated demineralised water are separated from one another at a pressure of 400 kPa.

9. Method according to claim 8, wherein the non-condensed proportion in the separator (37) is utilised to heat hot water for industrial use.

10. Method according to claim 9, wherein the water originates from another separator (43), with which water vapour originating from the first production process (3) is recovered and is available for industrial use after filtration.

11. Method according to claim 1, wherein the energy carrier of the second circuit (2) for cold production is guided in gas form from the condenser (39), in which the energy carrier becomes liquid, to a pump (17) that further drives the energy carrier to a heat exchanger (13) between the first circuit (1) for energy recovery and the second circuit (2) for cold production, after which the energy carrier of the second circuit (2) for cold production is reused in a subsequent cycle.

12. Method according to claim 1, wherein the compressor is a screw compressor with a rotor or equipped with vanes.

* * * * *